US008036563B2

(12) United States Patent
Kim

(10) Patent No.: US 8,036,563 B2
(45) Date of Patent: Oct. 11, 2011

(54) IMAGE FORMING APPARATUS

(75) Inventor: Yu-man Kim, Seongnam-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 915 days.

(21) Appl. No.: 11/972,757

(22) Filed: Jan. 11, 2008

(65) Prior Publication Data

US 2008/0181665 A1 Jul. 31, 2008

(30) Foreign Application Priority Data

Jan. 26, 2007 (KR) ..... 10-2007-0008306

(51) Int. Cl.
*G03G 15/00* (2006.01)

(52) U.S. Cl. ..... 399/90

(58) Field of Classification Search ..... None
See application file for complete search history.

(56) References Cited

U.S. PATENT DOCUMENTS 4,704,621 A 11/1987 van Cooten et al.
5,465,342 A * 11/1995 Walsh ..... 711/119
6,014,157 A * 1/2000 Slot et al. ..... 347/141
6,169,557 B1 * 1/2001 Suzuki et al. ..... 347/104

FOREIGN PATENT DOCUMENTS

| | | |
|---|---|---|
| JP | 11-72974 | 3/1999 |
| JP | 11-338329 | 12/1999 |
| JP | 2002-46334 | 2/2002 |
| KR | 2002-16572 | 3/2002 |

* cited by examiner

*Primary Examiner* — Matthew Luu
*Assistant Examiner* — Justin Seo
(74) *Attorney, Agent, or Firm* — Stanzione & Kim, LLP

(57) ABSTRACT

An image forming apparatus includes a toner storage part which stores a conductive and magnetic toner, a developing part which is accommodated in the toner storage part and generates magnetism, a hollow imaging drum which comprises a drum shaft parallel with the developing part, and a plurality of electrodes to apply electric magnetism to the toner attached to the developing part, a memory installed inside the imaging drum, a drum driver which rotatably drives the imaging drum; a data receiver which receives image data, and a main controller which controls the drum driver to keep stopping the imaging drum and stores the image data received by the data receiver in the memory if printing is requested.

21 Claims, 11 Drawing Sheets

IMAGE FORMING APPARATUS

CROSS-REFERENCE TO RELATED APPLICATIONS

This application claims priority from Korean Patent Application No. 10-2007-0008306, filed on Jan. 26, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, to an image forming apparatus which is capable of transmitting image data into an imaging drum with high reliability.

2. Description of the Related Art

An image forming apparatus is an electronic device which forms an image on a printing medium with a developing agent. The image forming apparatus is classified into an electrophotographic type which includes processes of electrification, exposure, development, transfer and fixation, and an ink-jet type which jets ink according to a printing method.

A general electrophotographic image forming apparatus includes a charger which uniformly charges a surface of a photosensitive drum to a potential and an exposure unit which exposes the charged surface of the photosensitive drum. However, since the image forming apparatus includes the charger and the exposure unit, spatial efficiency is not improved. Also, since processes of development and transfer are performed by a potential difference, development and transfer efficiencies decrease.

U.S. Pat. No. 4,704,621 discloses an image forming apparatus which uses an imaging drum where a plurality of electrodes are separately disposed on an insulating base instead of a photosensitive drum.

FIG. 1 is a schematic sectional view of a conventional image forming apparatus 1 which adopts an imaging drum 20. The image forming apparatus 1 includes a toner storage part 3 which stores a conductive and magnetic toner T, a cassette 4 which is loaded with a printing paper, a pickup part 6 which picks up the printing paper and a pair of feeding parts 7 which carry the printing paper. G indicates a paper guide, 31 indicates a paper preheating belt, and 33 and 35 indicate paper preheating belt driving parts, wherein the paper preheating belt driving part 33 includes a heating unit therein to heat the paper preheating belt. Reference numerals 43, 45 and 47 indicate a transfer part, a fixing part and a discharging part, respectively.

Meanwhile, the toner storage part 3 accommodates a developing part 10, and a toner in the toner storage part 3 is applied to an outer surface of the developing part 10. Referring to FIGS. 1 and 2, the developing part 10 includes a cylinder-shaped sleeve 15 of a conductive material, a plurality of magnets 11 provided inside the sleeve 15, and a magnetic knife 13 installed in a narrow space between the magnets 11 to generate an intensive magnetic field. Accordingly, the toner in the toner storage part 3 is led by the magnetic field by the magnets 11 in the developing part 10 to be applied to the outer circumference surface of the developing part 10.

Meanwhile, the imaging drum 20, as shown in FIG. 2, is disposed parallel with the developing part 10 with respect to a rotation axis thereof. In the imaging drum 20, a plurality of electrodes 23 are separately disposed on a base 21 of an insulating material, and a dielectric layer 22 encompasses the electrodes 23.

Image data to be printed is converted into an image signal to drive the electrodes 23 of the imaging drum 20 by an image processor 5. A slip ring is provided on a drum shaft 24 of the imaging drum 20 so that the image signal is simultaneously transmitted to an electrode driver (not shown) inside the imaging drum 20 during rotation of the imaging drum 20.

The slip ring is provided as a ring-shaped electrode pad on the outer circumference surface of the drum shaft 24 and rotated in contact with a cylinder-shaped stationary brush (not shown), thereby transmitting the image signal to the electrode driver (not shown). The electrode driver applies a voltage corresponding to the image data to the electrodes 23 connected thereto through lead lines 23*a* according to the image signal. Accordingly, an induced electric charge is generated in the toner T on the developing part 10 and transferred to the imaging drum 20 by electric magnetism. Thus, a toner visible image corresponding to the image data is formed on the imaging drum 20.

However, when the imaging drum 20 is rotated at a high speed, a contact area between the slip ring 23 and the stationary brush (not shown) is worn out or heat is generated in the contact area. Thus, a transmitted image signal may be distorted. In particular, a printing speed may not increase due to signal distortion.

A slip ring with excellent a wear-out resisting property and thermal stability may be used to prevent the signal distortion, but it increases the cost.

SUMMARY OF THE INVENTION

The present general inventive concept provides an image forming apparatus to prevent distortion of an image signal.

The present general inventive concept provides an image forming apparatus which solves the distortion of the image signal at a low cost.

The present general inventive concept provides an image forming apparatus which is improved in spatial efficiency.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing an image forming apparatus comprising a toner storage part which stores a conductive and magnetic toner, a developing part which is accommodated in the toner storage part and generates magnetism, a hollow imaging drum which comprises a drum shaft parallel with the developing part, and a plurality of electrodes to apply electric magnetism to the toner attached to the developing part, a memory installed inside the imaging drum, a drum driver which rotatably drives the imaging drum, a data receiver which receives image data, and a main controller which controls the drum driver to keep the imaging drum stopping and stores the image data received by the data receiver in the memory if printing is requested.

The image forming apparatus may further include an electrode driver which is installed inside the imaging drum and applies a voltage to the respective electrodes, and the main controller may control the drum driver and the electrode driver so that the imaging drum is rotated and a voltage is applied to the electrode corresponding to the image data stored in the memory if the image data is completely stored in the memory.

The image forming apparatus may further include a signal input part which comprises at least one of a power input contact point and an image data input contact point and is formed to rotate with the imaging drum in a single body, a signal output part which comprises at least one of a power output contact point in contact with the power input contact point and an image data output contact point in contact with the image data input contact point, and a power supplier which supplies power to the power output contact point, wherein the main controller provides the image data to the image data output contact point.

At least one of the signal output part and the signal input part may be provided to be relatively movable to the other so as to be electrically connected and disconnected with each other.

The image forming apparatus may further include a connecting part which moves the signal output part between an in-contact position where the signal output part is connected to the signal input part and an out-of-contact position where the signal output part is disconnected from the signal input part, wherein the main controller controls the connecting part to move the signal output part to the in-contact position if the image data is being received and to the out-of-contact position if the image data has been completely received.

The drum driver may include a driving source and an electronic clutch, and the main controller turns on/off power of the electronic clutch to supply and block a driving force from the driving source to the imaging drum, respectively.

The driving source may include a driving pinion, and the electronic clutch may be provided to be slidable between a power transmitting position and a power transmitting release position distanced apart from the power transmitting position along a shaft of the imaging drum, and include a driven part rotated by the driving pinion and a connecting part provided to rotate with the shaft of the imaging drum in a single body to move the driven part to the power transmitting position and the power transmitting release position according to the on/off of the power, respectively.

The signal output part may be provided to be slidable between an in-contact position where the signal output part is connected to the signal input part and an out-of-contact position where the signal output part is disconnected from the signal input part along the drum shaft.

The drum driver may include a driving source which comprises a driving pinion to rotate on a driving shaft parallel with the drum shaft, a driven part which is rotated by the driving pinion and provided to be slidable between the power transmitting position and the power transmitting release position distanced apart from the power transmitting position along the drum shaft, and a connecting part which is provided to rotate with a drum shaft in a single body and moves the driven part to the power transmitting position and the signal output part to the out-of-contact position, and the driven part to the power transmitting release position and the signal output part to the in-contact position respectively according to turning on/off a power.

The main controller may turn off power of the connecting part if printing is requested and turn on the power of the connecting part if the image data is completely stored in the memory.

The connecting part may include an electromagnet.

The connecting part may include an electromagnet.

The connecting part may include an electromagnet.

The image forming apparatus may further include a wireless transmitter which transmits the image data wirelessly, and a wireless receiver which is provided inside the imaging drum and transmits the transmitted image data to the memory, wherein the main controller controls the wireless transmitter and the wireless receiver so as to transmit/receive the image data wirelessly.

The memory may include a storage part and a memory driver which stores the image data received by the wireless receiver in the storage part.

The main controller may be provided inside the imaging drum, and the image forming apparatus may further include a wireless communication controller which controls the wireless transmitter to transmit the image data received by the data receiver to the wireless receiver if printing is requested.

The foregoing and/or other aspects and utilities of the present general inventive concept can also be achieved by providing an imaging drum usable with an image forming apparatus, the imaging drum including a hollow cylinder, a plurality of electrodes disposed in the hollow cylinder to form an electric magnetism corresponding to an image on a surface of the hollow cylinder, and a memory disposed in the hollow cylinder to store image data corresponding to the image and to transmit the stored image data to corresponding ones of the plurality of electrodes, wherein the hollow cylinder stops moving when the memory receive the image data from an external device.

The imaging drum may further include a wireless communication unit disposed in the hollow cylinder to communicate with the external device to wirelessly receive the image data from the external device.

The imaging drum may further include a controller disposed in the hollow cylinder to wirelessly receive a control signal from the external device to control the memory and the plurality of electrodes.

The imaging drum may further include a unit to transmit the image data from the external device to the memory, and a connecting part to control the first unit to selectively transfer the image data from the external device to the memory.

The imaging drum may further include a drum shaft disposed on an end portion of the hollow cylinder; a first unit disposed on the drum shaft to transmit the image data from the external device to the memory, a second unit disposed on the drum shaft to transfer a rotation power to the drum shaft, and a connecting part disposed on the drum shaft to control the first unit and second unit to selectively transfer the image data and the rotation power to the memory and the drum shaft, respectively.

The first unit and the second unit are movably disposed on the drum shaft on opposite sides with respect to the connecting part.

The foregoing and/or other aspects and utilities of the present general inventive concept can also be achieved by providing an image forming apparatus including an imaging drum having a hollow cylinder, a plurality of electrodes disposed in the hollow cylinder to form an electric magnetism corresponding to an image on a surface of the hollow cylinder, and a memory disposed in the hollow cylinder to store image data corresponding to the image and to transmit the stored image data to corresponding ones of the plurality of electrodes, and a controller to control the hollow cylinder to stop moving when transmitting the image data to the memory.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
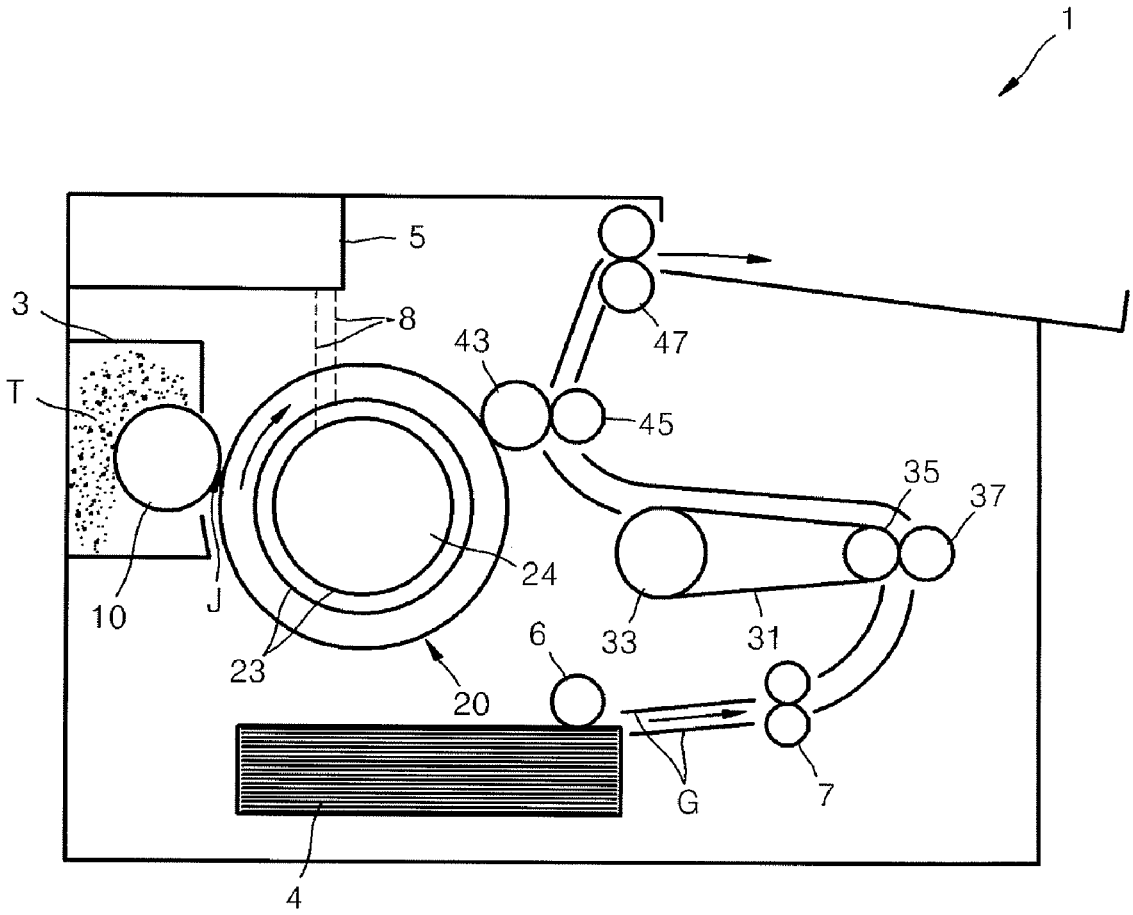
FIG. 1 (RELATED ART)
FIG. 1 is a schematic sectional view of a conventional image forming apparatus.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Figure 3:
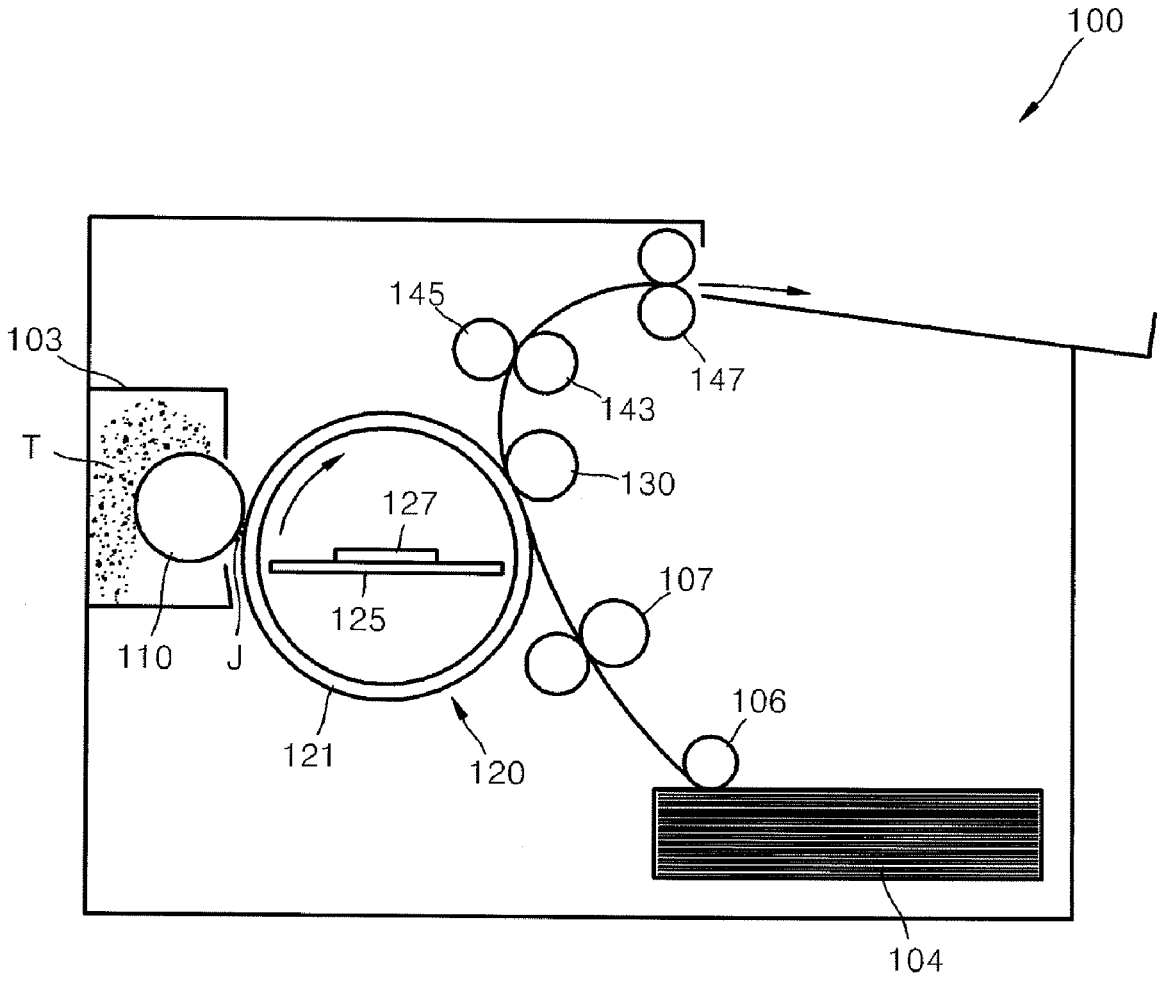
FIG. 3 is a schematic sectional view of an image forming apparatus according to an exemplary embodiment of the present general inventive concept.

Referring to FIG. 3, an image forming apparatus 100 according to an exemplary embodiment of the present general inventive concept includes a toner storage part 103 which stores a developer, such as a conductive and magnetic toner T, a cassette 104, a pickup part 106, a feeding part 107, a developing part 110, an imaging drum 120, a transfer part 130, fixing parts 143 and 145 and a discharging part 147.

Figure 2:
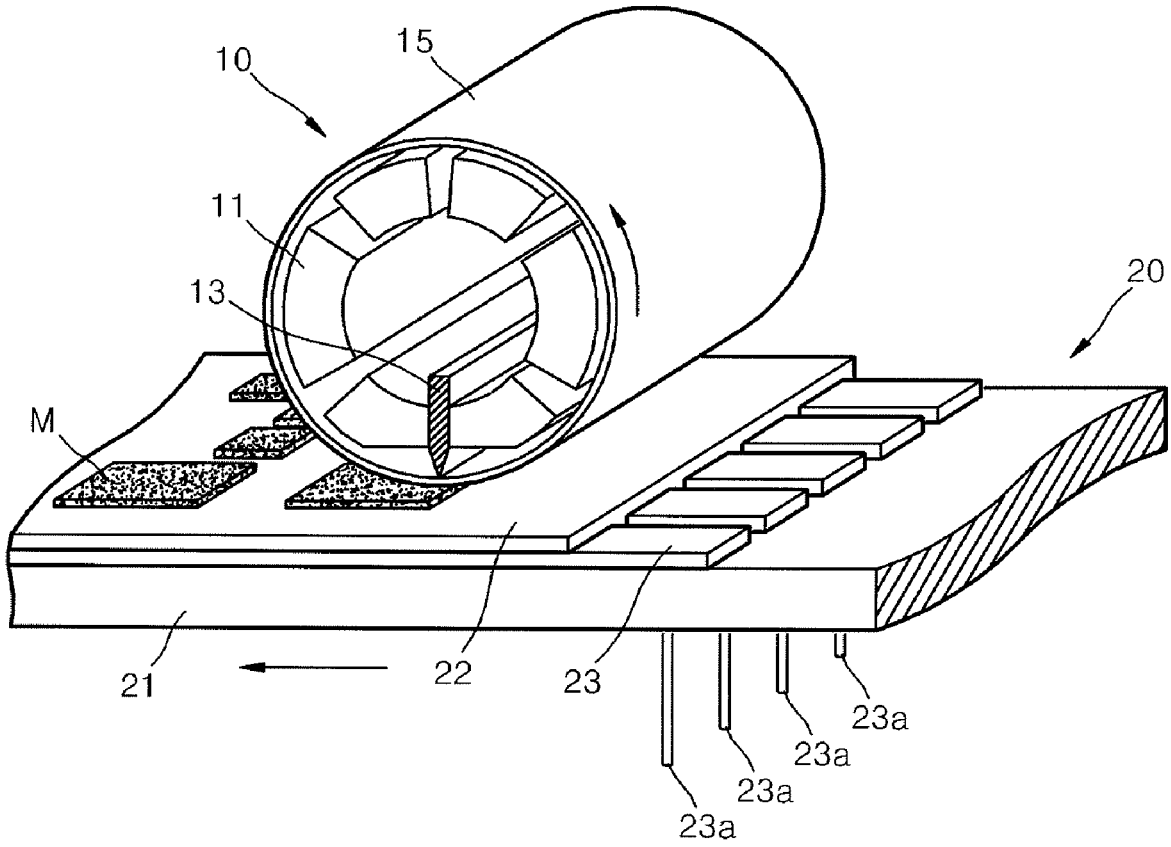
FIG. 2 (RELATED ART)
FIG. 2 is an enlarged perspective view of a main part of the image forming apparatus in FIG. 1.

The developing part 110 may be similar to a conventional developing part 10 of FIGS. 1 and 2, and thus descriptions thereof will not be repeated. The developing part 110 may be provided as a belt, which is not shown in the drawing. Further, the developing part 110 may have various shapes as long as it develops an image on the imaging drum 120 with the toner T.

Figure 4A:
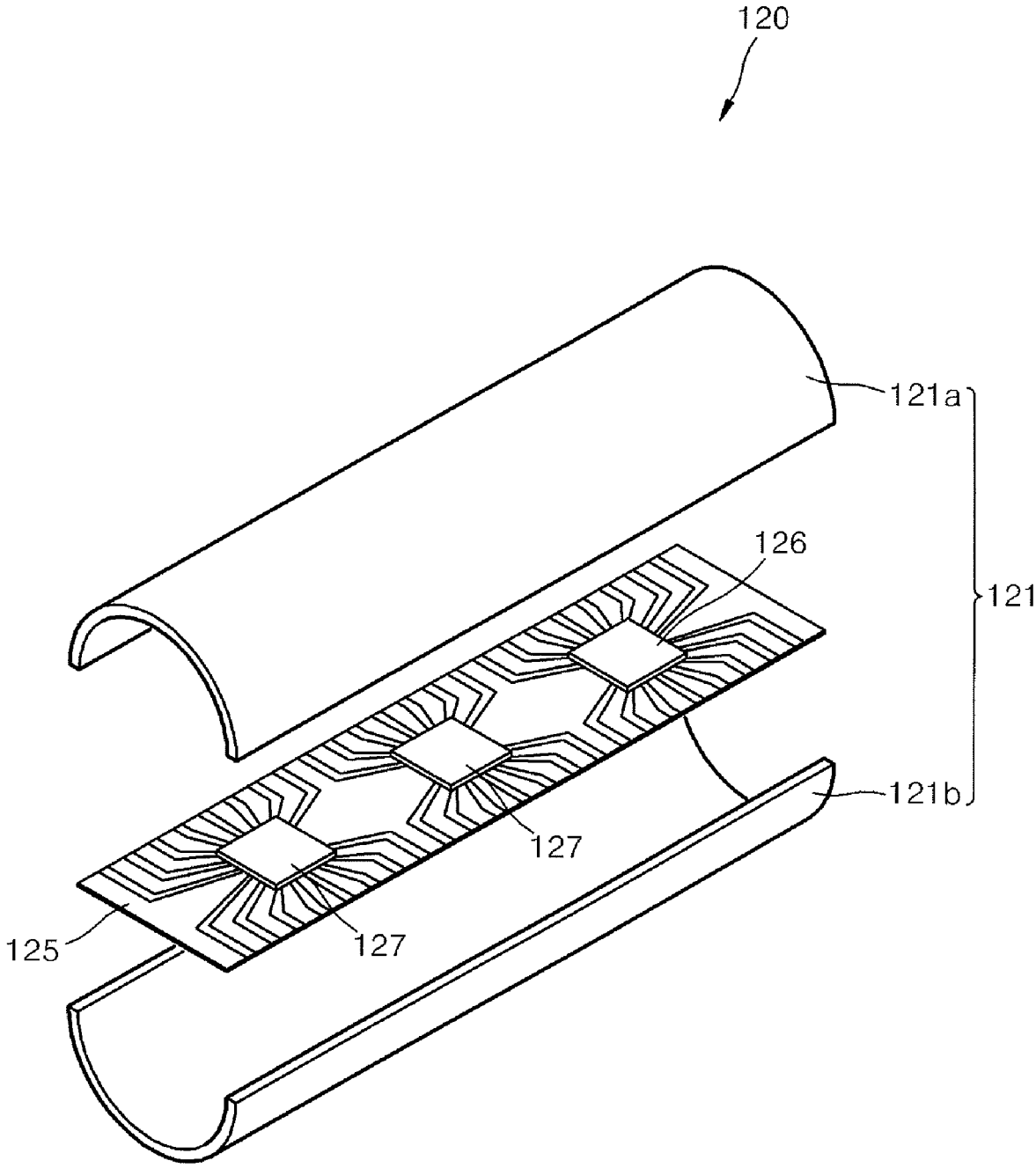
FIGS. 4A through 4C are schematic perspective views to illustrate an order of manufacturing an imaging drum of the image forming apparatus in FIG. 3.

Referring to FIGS. 3 and 4A, the imaging drum 120 includes a base 21 which may include bases 121*a* and 121*b*, a substrate 125 provided inside the bases 121*a* and 121*b*, an electrode driver 127, and a memory 126. The electrode driver 127 and the memory 126 may be installed on the substrate 125. The bases 121*a* and 121*b* may have a half circular section or a hollow cylindrical plate.

Figure 5:
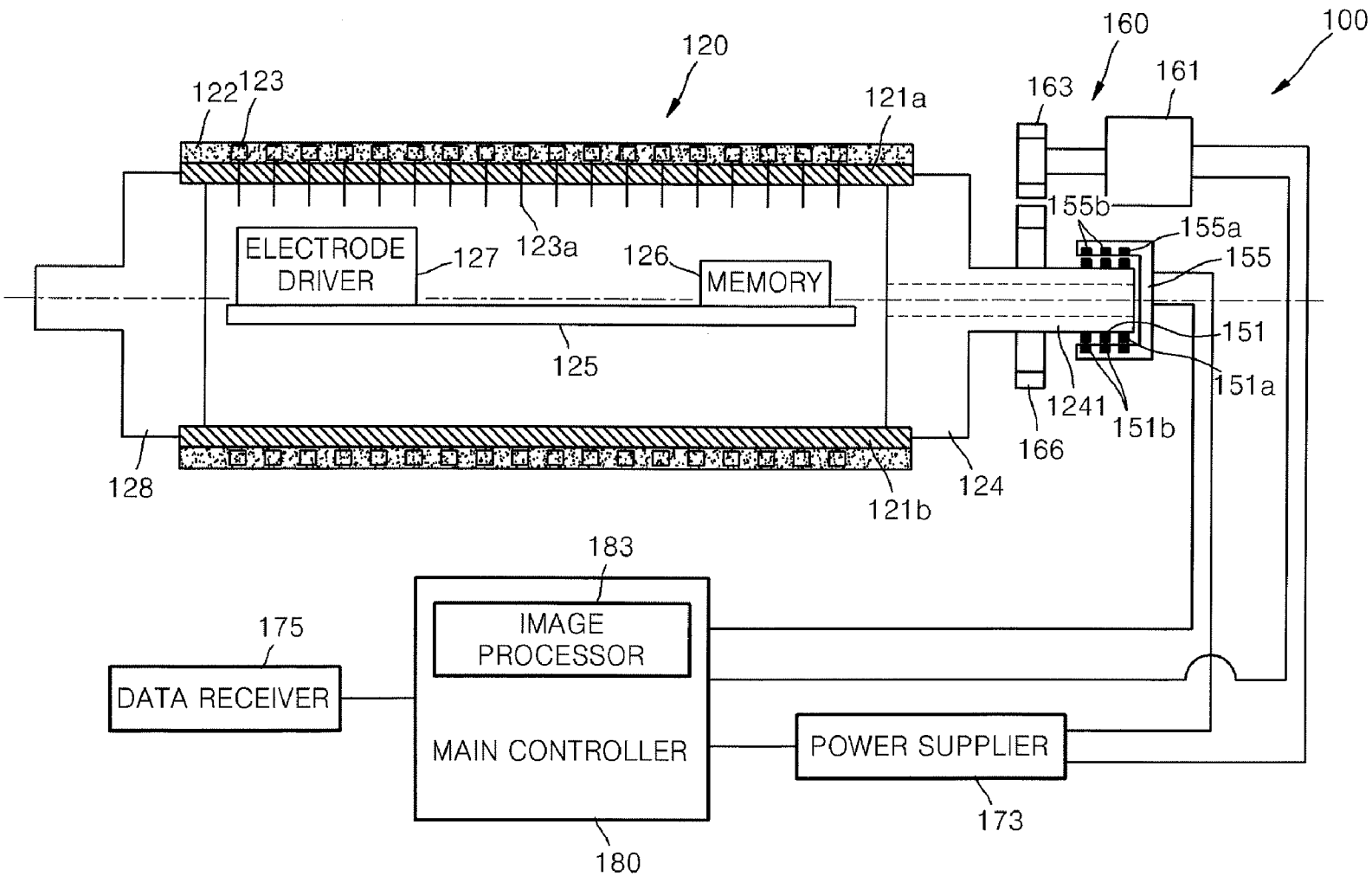
FIG. 5 is a schematic view of the image forming apparatus in FIG. 3.

Referring to FIG. 5, the electrode driver 127 applies a voltage to a plurality of electrodes 123 through respective lead lines 123*a* of the electrodes 123 corresponding to image data stored in the memory 126. Here, the image data is defined as data inputted to the electrode driver 127 to drive the electrodes 123 according to an image requested to be printed. The image data may be inputted directly from a host computer of the image forming apparatus 100 by a user's request of printing, or made by an image processor 183 of a main controller 180 by processing image raw data inputted from a data receiver 175. The data receiver 175 may receive the image raw data from an external device.

The lead lines 123*a* and the electrode driver 127 are electrically connected through an electrode driver line (not shown). If the electrodes 123 are provided to have a predetermined resistance value, they may be applied with a current instead of a voltage.

The memory 126 temporarily stores image data inputted from an image data input contact point 151*b* and will be described later.

Figure 4B:
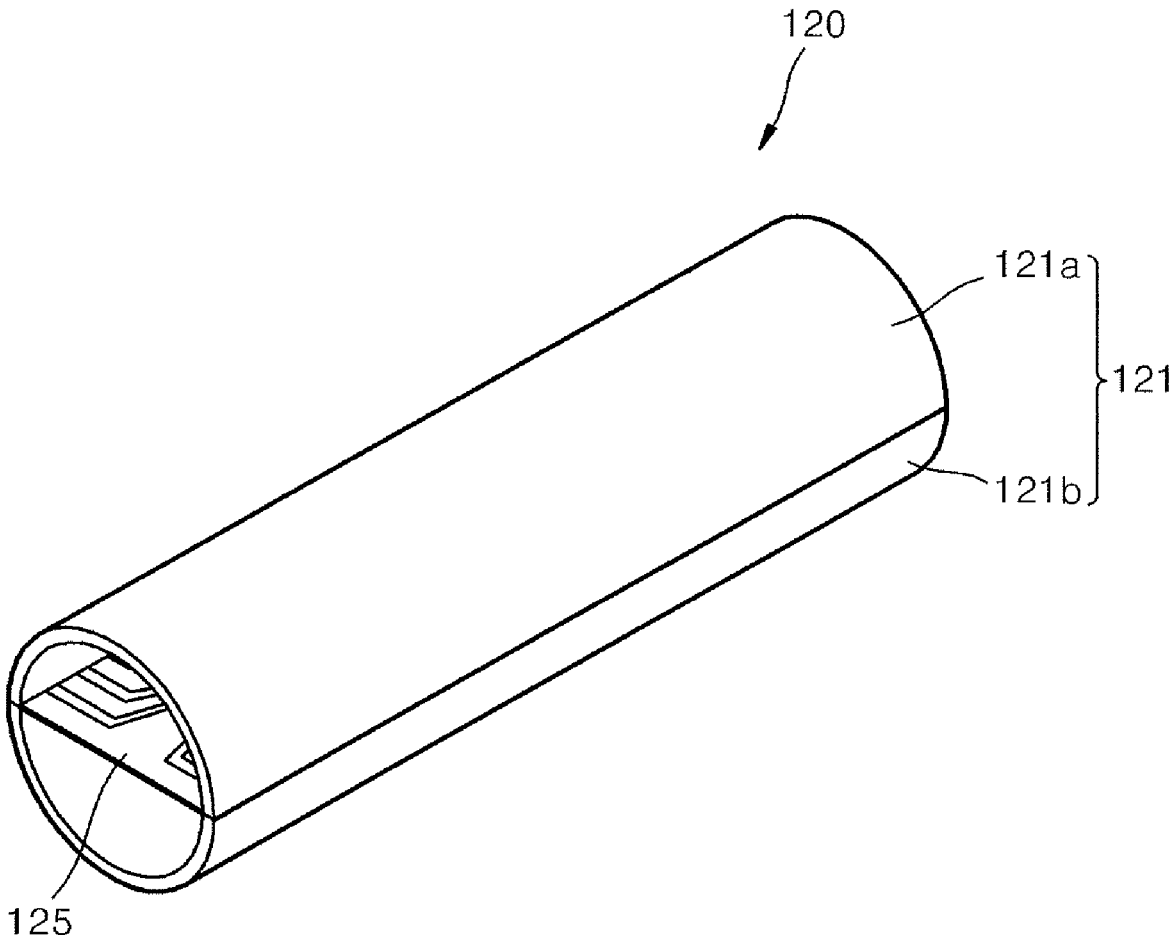

Referring back to FIG. 4A, the bases 121*a* and 121*b* may be made of metal coated with non-conductive material. Referring to FIG. 4B, the bases 121*a* and 121*b* with a half circle-shaped section are combined to complete the cylinder-shaped base 121. Here, the base may be two separate structures of the bases 121*a* and 121*b* rather than a single body structure in order to conveniently install the substrate 125 where the electrode driver 127 and the memory 126 are disposed therein-side. However, the single-body base may be used if necessary to install the substrate 125. The substrate 125 may be rotatably combined with the base 121 in a single body.

Figure 4C:
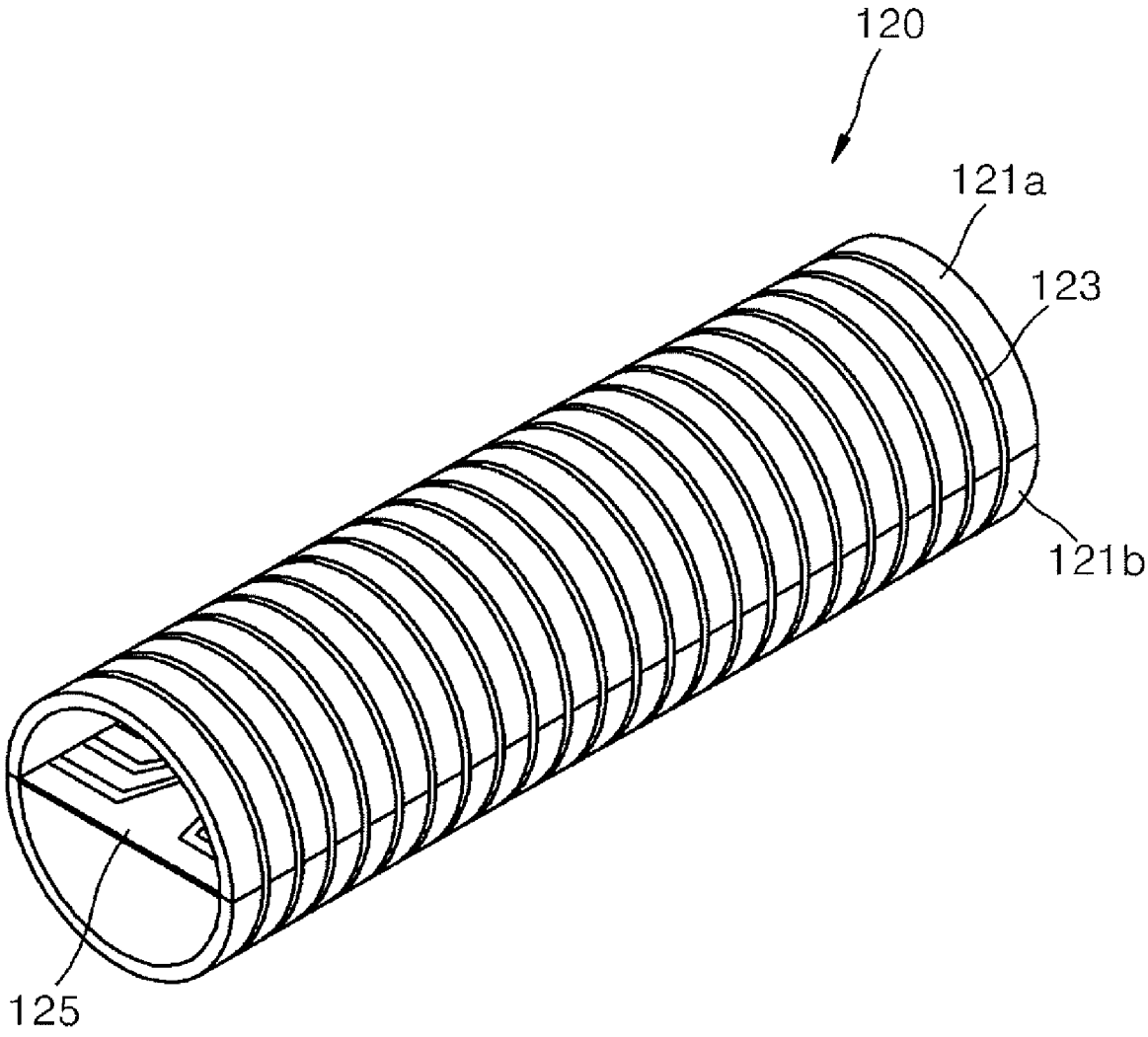

Referring to FIG. 4C, a plurality of electrodes 123 are disposed on the base 121 in a circular direction and spaced-apart from each other by an interval along a lengthwise direction. The electrodes 123 may be ring electrodes. To perform a resolution of 600 dpi, 600 electrodes per inch are disposed at a regular interval of about 43 μm along the lengthwise direction. A dielectric layer 122 is formed between the ring electrodes 123 to insulate the ring electrodes 123 from each other.

Referring to FIG. 5, the imaging drum 120 further includes a first drum shaft 124 where a power input contact point 151*a* and the image data input contact point 151*b* are formed on an outer circumference surface thereof at one end part, and a second drum shaft 128 disposed at the other end part.

The power input contact point 151*a* and the image data input contact point 151*b* rotatably contact with a power output contact point 155*a* and an image data output contact point 155*b* of a signal output part 155 which are described later. The power input contact point 151*a* is inputted a driving power to drive components disposed inside the base 121 such as the memory 126 and the electrode driver 127.

The image data input contact point 151*b* is connected to the memory 126 through a wire or wirelessly to transmit image data to be stored in the memory 126.

The signal output part 155 includes the power output contact point 155*a* and the image data output contact point 155*b* which are disposed corresponding to the power input contact point 151*a* and the image data input contact point 151*b*. The signal output part 155 may be stationary inside the image forming apparatus 100. A signal input part 151 having the power input contact point 151*a* and the image data input contact point 151*b* may be not stationary but movable.

The power output contact point 155*a* is supplied with power from a power supplier 173 to transmit the power to the power input contact point 151*a*. The image data output contact point 155*b* is connected to the main controller 180 to transmit an image data outputted from the main controller 180 to the image data input contact point 151*b*.

Referring to FIG. 5, the image forming apparatus 100 according to the present exemplary embodiment may further include the signal output part 155, a drum driver 160, the power supplier 173, the data receiver 175 and the main controller 180, and a driving unit to drive the image drum.

The drum driver 160 includes a driving motor 161, a driving pinion 163 connected to a shaft of the driving motor 161 and a driven part 166. As shown in FIG. 5, the driven part 166 may be provided as a gear which engages with the driving pinion 163. The driven part 166 may rotatably be combined with a shaft part 1241 of the first drum shaft 124 in a single body. The driven part 166 may be provided as other driving means such as a belt, a friction wheel, etc. as necessary.

The power supplier 173 converts power supplied from an outside of the image forming apparatus 100 into power required by electronic components in the apparatus 100.

The data receiver 175 receives data transmitted from the host computer (not shown) which is connected to the image forming apparatus 100 through wired or wireless network. The data may be the aforementioned image data or an image raw data.

The main controller 180 may control all configuration elements involved in a printing process of the image forming apparatus. The electrode 123 of the imaging drum 120 of the image forming apparatus 100 may not be controlled by the main controller 180 but separately controlled by the electrode driver 127. Further, if a data which the data receiver 175 receives is not appropriate for an input data to the electrode driver 127, the main controller 180 may further include the image processor 183 to process the data to be suitable for the input data.

Hereinafter, a printing process of the image forming apparatus 100 with the aforementioned configuration will be explained in brief. First, the main controller 180 determines whether printing is requested. If the printing is requested, the pickup part 106 and the feeding part 107 are driven to feed a printing medium loaded in the cassette 104 to the imaging drum 120.

Meanwhile, if data which the data receiver 175 receives is image raw data, the main controller 180 controls the image processor 183 to convert the data into image data. Then, the main controller 180 inputs or transmits the image data to the signal output part 155.

The main controller 180 turns off the power being supplied to the drum driver 160 to keep stopping the imaging drum 120 until image data transmitted through the image data output contact point 155*b* of the signal output part 155 and the image data input contact point 151*b* of the signal input 151 is stored in the memory 126. Accordingly, the image data output contact point 155*b* and the image data input contact point 151*b* are not rotated frictionally, thereby preventing signal distortion.

Meanwhile, the main controller 180 determines whether the image data is completely stored in the memory 126. If the image data is completely stored in the memory 126, the main controller 180 controls the power supplier 173 to turn on the power to the drum driver 160 to rotatably drive the imaging drum 120. Then, the main controller 180 controls the electrode driver 127 to apply a voltage to the plurality of electrodes 123 according to the image data stored in the memory 126.

The toner T applied to the surface of the developing part 110 is induced with an electric charge by a potential difference formed on a surface of the imaging drum 120 in an image forming space J in FIG. 3. Accordingly, the toner T is transferred to the imaging drum 120, and a toner visible image is formed on the dielectric layer 122 of the imaging drum 20.

The toner visible image is transferred to a printing medium passing between the transfer part 130 and the imaging drum 120 by electric magnetism or surface energy of the transfer part 130. When using the surface energy, it is effective to coat the surface of the imaging drum 120 with a material which has low surface energy such as silicon, Teflon, or the like. As necessary, the magnetic field may be generated in the transfer part 130 to transfer the toner visible image to the printing medium.

The toner visible image transferred to the printing medium is fixed on the printing medium by heat and pressure via a press part 143 and a heat part 145, and then discharged by the discharging part 147 to an outside thereof. Thus, the printing process is completed.

The aforementioned printing process employs a direct transfer method where a printing medium passes between the imaging drum 120 and the transfer part 130. However, an indirect transfer method where a printing medium passes between the transfer part 43 and the fixing part 45, shown in FIG. 1, may be used.

Figure 6:
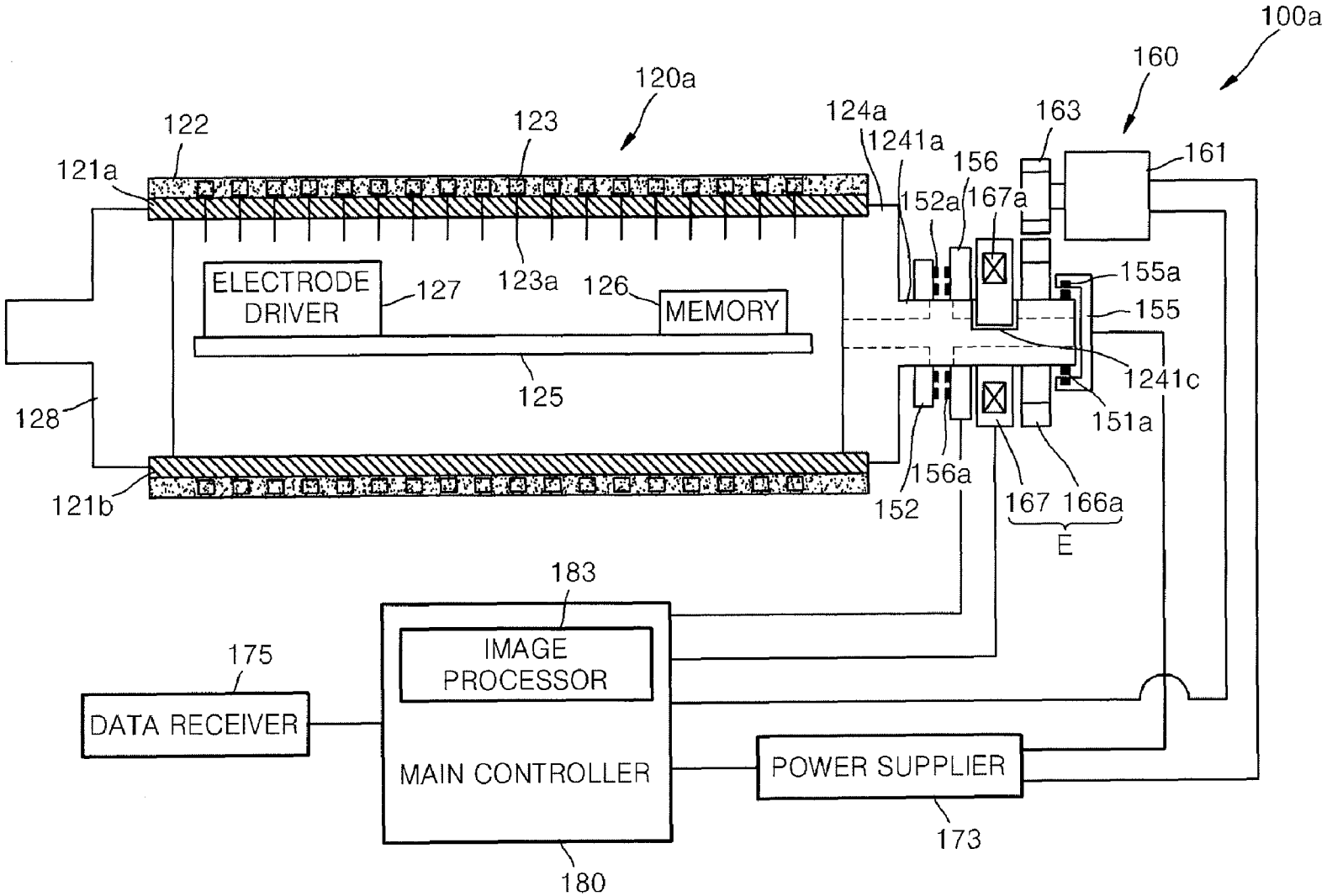
FIG. 6 is a schematic view of an image forming apparatus according to an exemplary embodiment of the present general inventive concept.

FIG. 6 is a schematic view of an image forming apparatus 100*a* according to an exemplary embodiment of the present general inventive concept.

Referring to FIG. 6, in the image forming apparatus 100*a* according to the exemplary embodiment, image data and power are transmitted to an imaging drum 120*a* along different paths, unlike in the embodiment of FIG. 5.

That is, the image data is transmitted through a signal input part 152 and a signal output part 156 which are provided on an outer circumference surface of a shaft part 1241*a* of a first drum shaft 124*a* in a radial direction to face each other, while the power is provided to an electrode driver 127 and a memory 126 in the imaging drum 120*a* through a power input contact point 151*a* and a power output contact point 155*a* which are provided on another surface of the shaft part 1241*a*.

An image data input contact point 152*a* and an image data output contact point 156*a* are provided at corresponding positions to the signal input part 152 and the signal output part 156, respectively, to be in contact with each other. Further, the image data input contact point 152*a* and the image data output contact point 156*a* may be provided to rotatably contact with the signal input part 152 and the signal output part 156 along a lengthwise direction of the imaging drum 120*a*, respectively.

Here, the signal output part 156 may be provided to be movable between an in-contact position where it is in contact with the signal input part 152 to be electrically connected and an out-of-contact position where it is out of contact with the signal input part 152 along a lengthwise direction of the shaft part 1241*a* of the first drum shaft 124*a*.

Meanwhile, a connecting part 167 may be interposed between the signal output part 156 and the driven part 166*a*. A first gap is formed between the signal output part 156 and the connecting part 167 and a second gap between the driven part 166*a* and the connecting part 167, respectively.

The driven part 166*a* is rotatably installed on the shaft part 1241*a* of the drum shaft 124*a* unlike in the present embodiment of FIG. 3. The driven part 166*a* is rotated by the driving pinion 163. Further, the driven part 166*a* may be provided to slidably move between a power transmitting position and a power transmitting release position along a lengthwise direction of the drum shaft 124*a*. The driven part 166*a* transmits a rotation power of the driving pinion 163 to the drum shaft 124*a* to rotatably drive the imaging drum 120*a* at the power transmitting position, while it blocks the power from being transmitted to the imaging drum 120*a* at the power transmitting release position.

The connecting part 167 is installed on the shaft part 1241*a* to be provided to rotate with the drum shaft 124*a* in a single body. The connecting part may be installed in a D-shaped cut portion 1241*c* formed in the shaft part 1241*a*. The connecting part 167 may be rotatably combined with the drum shaft 124*a* in a single body by other methods besides the D cut part 1241*c*.

The connecting part 167 includes an electromagnet 167*a* therein to move a driven part 166*a* and the signal output part 156. The driven part 166*a* and the signal output part 156 may be formed in a direction perpendicular to a rotation axis of the shaft part 1231*a* or the image drum 120*a*, and may move in the rotation axis with respect to the shaft part 1231*a* or the image drum 120*a*.

As the power of the connecting part 167 is turned on, the electromagnet 167*a* moves the driven part 166*a* to a power transmitting position so that the connecting part 167 and the driven part 166*a* are rotatably combined in a single body. Accordingly, the imaging drum 120*a* is rotated by the rotation power of the drum driver 160 transmitted to the driven part 166*a*. Meanwhile, the connecting part 167 moves the signal output part 156 to the out-of-contact position so as not to be in contact with the signal input part 152. Accordingly, the signal input part 152 and the signal output part 156 through which image data is transmitted are out of contact during the rotation of the imaging drum 120*a*, thereby not generating distortion of signals due to wear-out and heat by friction.

When the power of the connecting part 167 is turned off, the driven part 166*a* moves to the power transmitting release position to perform an idle rotation with respect to the shaft part 1241*a* of the drum shaft 124*a*. Accordingly, the power of the driven part 166*a* is not transmitted to the drum shaft 124*a*. Meanwhile, the signal output part 156 moves to an in-contact position to be in contact with the signal input part 152, so that an image data is transmitted to the memory 126 through the signal input part 152.

Here, signal distortion generated in transmitting an image data may be solved by turning on/off the power of the connecting part 167 without turning on/off the power of the drum driver 160. When image data is to be transmitted into the imaging drum 120*a*, i.e., printing is requested, the signal input part 152 is moved to the in-contact position while the power to the drum driver 160 is blocked from being transmitted to the drum shaft 124*a* as the main controller 180 turns off the power of the connecting part 167. Accordingly, the signal input part 152 and the signal output part 156 are in contact, thereby transmitting image data to the memory 126.

When the image data is completely transmitted, the main controller 180 turns on the power of the connecting part 167 so that the driving power of the drum driver 160 is transmitted to rotate the imaging drum 120*a*. At the same time, the signal input part 152 is moved to an out-of-contact position so that the signal input part 152 and the signal output part 156 are out of contact. Accordingly, wear-out due to friction and thermal deformation due to friction heat according to the rotation of the imaging drum 120*a* may be controlled. Additionally, a life span of a structure of transmitting image data can be improved. Also, the connecting part 167 is controlled without turning on/off the power of the drum driver 160, and thus the drum driver 160 may drive a rotating body such as a pickup part 106 in FIG. 3, a developing part 110, etc., as well as the imaging drum 120*a*.

It is possible that a structure where power and an image data are transmitted into the imaging drum 120*a* instead of the signal output part 156 and the signal input part 152*a* may be formed the same as in the exemplary embodiment of FIG. 5 and an electronic clutch E which includes the connecting part 167 and the driven part 166*a* may be used. In this case, the imaging drum 120*a* may be rotated or stopped by turning on/off the power of the connecting part 167 without turning on/off the power of the drum driver 160.

Figure 7:
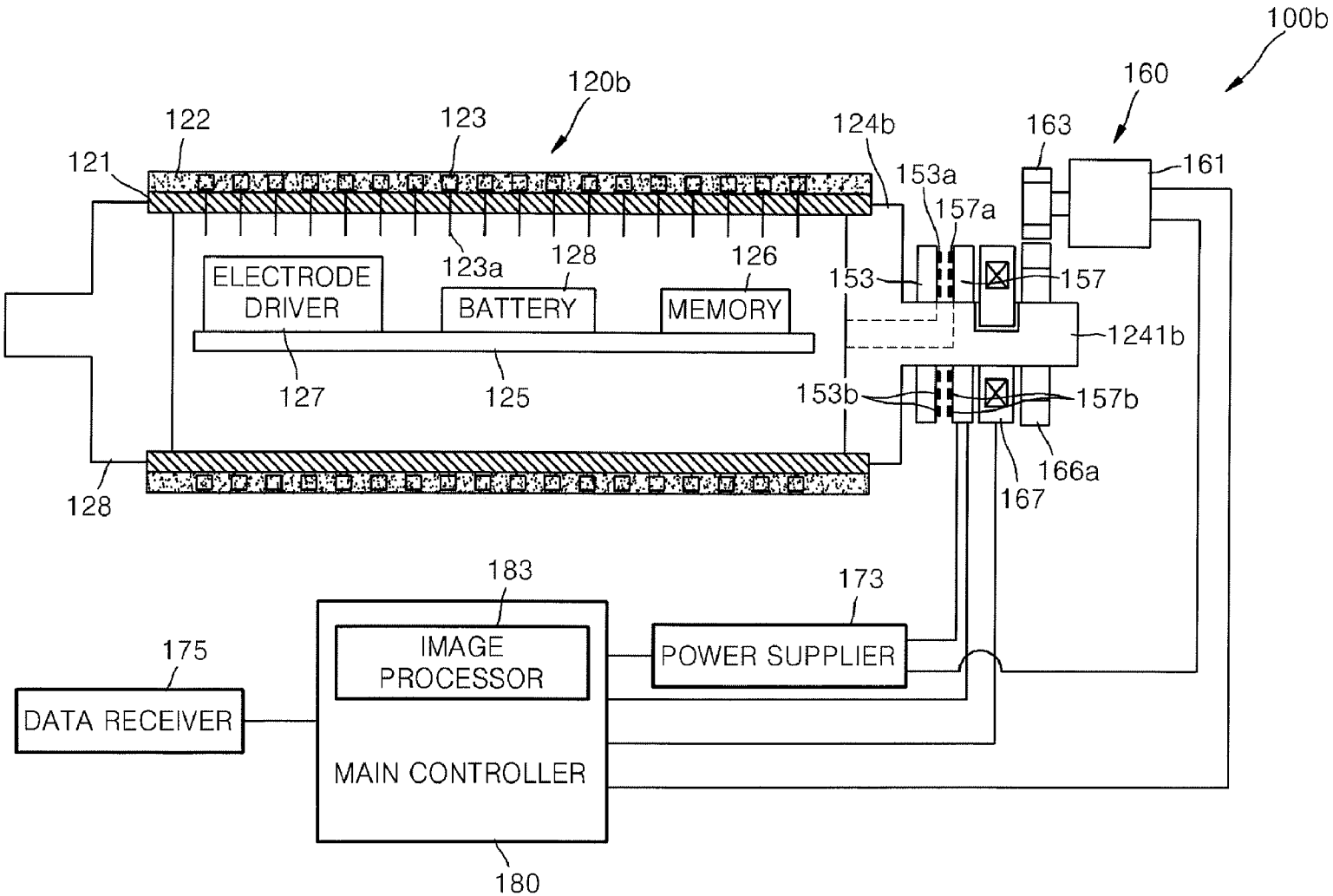
FIG. 7 is a schematic view of an image forming apparatus according to an exemplary embodiment of the present general inventive concept.

FIG. 7 is a schematic view of an image forming apparatus 100*b* according to an exemplary embodiment of the present general inventive concept.

Referring to FIG. 7, the image forming apparatus 100*b* according to the present embodiment has a structure where power and an image data are transmitted through a signal input part 153 and a signal output part 157.

The power is transmitted into an imaging drum 120*b* by a power output contact point 157*a* and a power input contact point 153*a* being in contact. The image data is transmitted to a memory 126 through an image data output contact point 157*b* and an image data input contact point 153*b*.

The signal output part 157 is provided to slidably move between an in-contact position and an out-of-contact position along a lengthwise direction of a shaft part 1241*b* of a drum shaft 124*b* the same as the signal output part 156 in the exemplary embodiment of FIG. 6. Accordingly, a driving power may be transmitted to electronic components in the imaging drum 120*b* when the imaging drum 120*b* is not rotated, while the driving power is transmitted all the time regardless of the rotation of the imaging drums 120 and 120*a* in the exemplary embodiments of FIGS. 5 and 6. As described above, a first gap is formed between the signal output part 157 and the connecting part 167 and a second gap is formed between the driven part 166*a* and the connecting part 167, so that the signal output part 157 slidably moves between the in-contact position and the out-of-contact position, and the driving power is transmitted.

Thus, the imaging drum 120*b* may further include a battery 125 therein to drive an electrode driver 127 and the memory 126. The battery 125 may be charged by blocking the power of a connecting part 167 to enable the signal output part 157 and the signal input part 153 to be in contact with each other when the image forming apparatus 100*b* does not perform a printing process.

Figure 8:
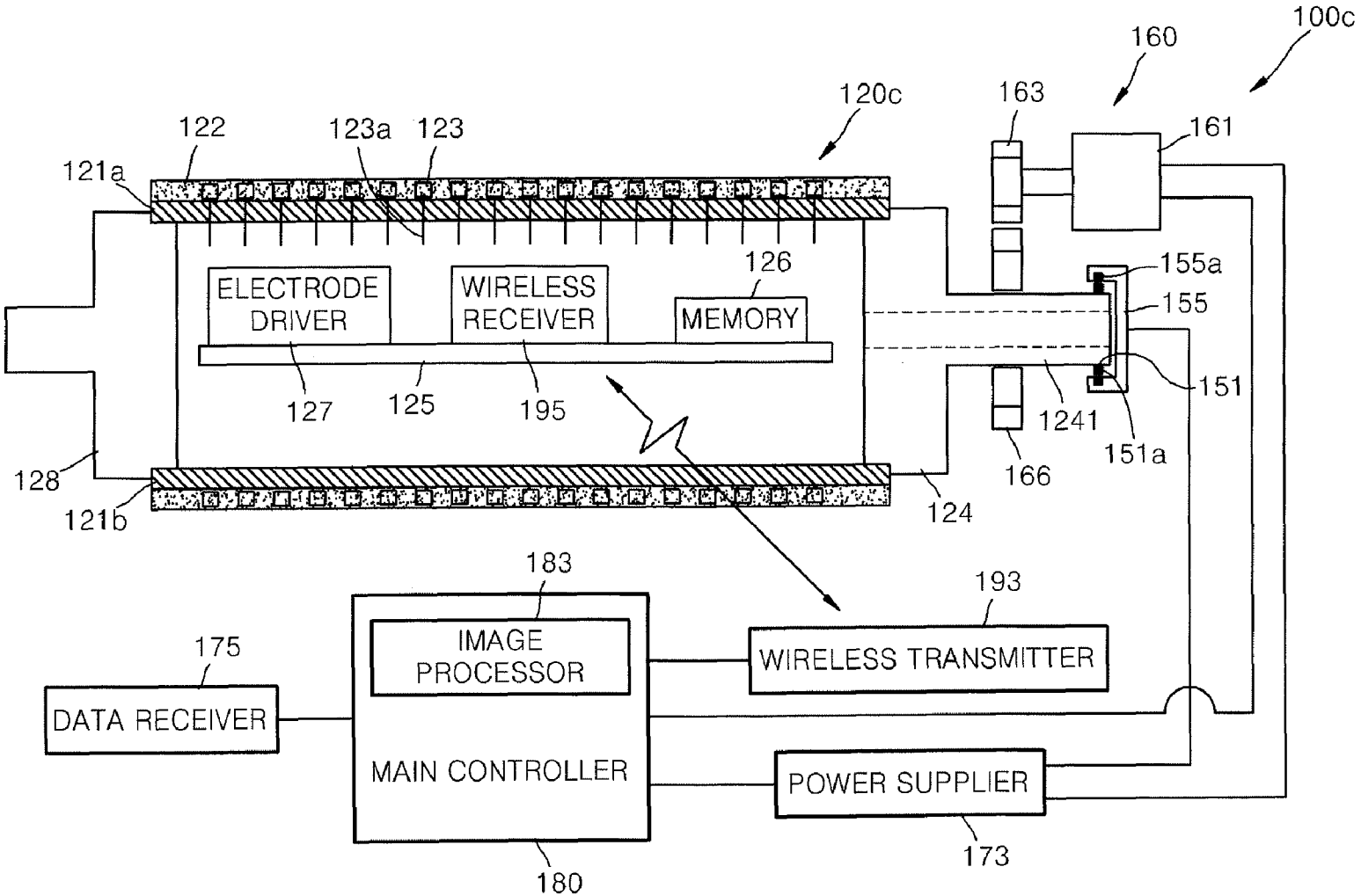
FIG. 8 is a schematic view of an image forming apparatus according to an exemplary embodiment of the present general inventive concept.

FIG. 8 is a schematic view of an image forming apparatus 100*c* according to an exemplary embodiment of the present general inventive concept.

Referring to FIG. 8, the image forming apparatus 100*c* includes a wireless transmitter 193 and a wireless receiver 195 which can wirelessly transmit image data to a memory 126 in an imaging drum 120*c*. The wireline signal input parts 151 and 153 and signal output parts 155, 156 and 157 are used to transmit the image data in the exemplary embodiments of FIGS. 5, 6, and 7, while the image signal is transmitted wirelessly in the present embodiment of FIG. 8.

The wireless receiver 195 is connected to the memory 126 on a substrate 125 to transmit the received image data to the memory 126. Here, the memory 126 may include a storage part (not shown) and a memory driver (not shown) to store image data received by the wireless receiver 195 in the storage part.

Meanwhile, power to be supplied to electronic components in the imaging drum 120*c* is transmitted by the same method as in the embodiment of FIG. 6. Accordingly, spatial efficiency in the image forming apparatus 100*c* may be improved as compared with that by the wireline system. Further, image data is not transmitted by a wireline contact method as described in the embodiment of FIG. 5, thereby improving durability.

Figure 9:
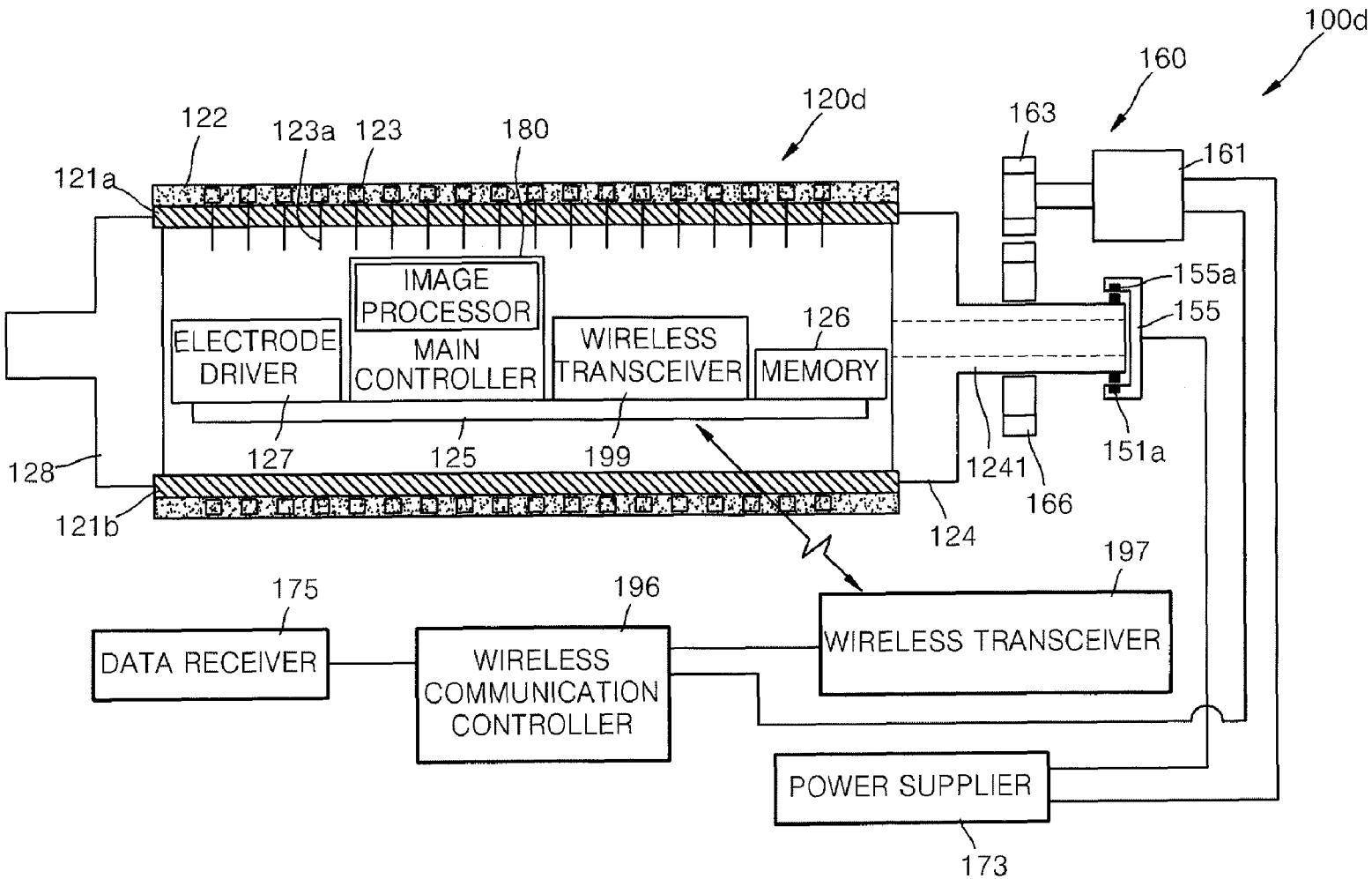
FIG. 9 is a schematic view of an image forming apparatus according to an exemplary embodiment of the present general inventive concept.

FIG. 9 is a schematic view of an image forming apparatus 100*d* according to an exemplary embodiment of the present general inventive concept.

Referring to FIG. 9, the image forming apparatus 100*d* includes a main controller 180 installed on a substrate 125 in an imaging drum 120*d*, which is different from the embodiment of FIG. 8.

It is possible that image data may be transmitted to a memory 126 not by a wireless method illustrated in FIG. 9, but by a wireline communication method used in the embodiments of FIGS. 5, 6, and 7. In this case, configuration elements which are to be controlled and disposed outside the imaging drum 120*d* may communicate with the memory 126 through a wire, that is, by a wireline system.

In the wireless method in FIG. 9, however, the image forming apparatus 100*d* may further include a wireless communication controller 196 so that the main controller 180 installed in the imaging drum 120*d* controls the entire image forming apparatus 100*d*. The wireless communication controller 196 controls a wireless transceiver 197 so that the main controller 180 wirelessly transmits/receives data to/from elements which are disposed inside and/or outside the imaging drum 120*d* to be controlled. For example, when the image data is received by the data receiver 175, the wireless communication controller 196 controls the received image data to be transmitted to the wireless transceiver 197 to be wirelessly transmitted to the imaging drum 120*d*. For another example, the wireless communication controller 196 may control the wireless transceiver 197 so that a control signal of a drum driver 160 from the main controller 180 is transmitted to the drum driver 160 through wireless transceivers 197 and 199.

Meanwhile, the wireless transceiver 199 is installed on the substrate 125 so that the main controller 180 and the configuration elements within the image forming apparatus 100*d* can wirelessly communicate with each other in two-ways, e.g., by a bidirectional communication, besides the image data, which is different from in the embodiment of FIG. 8. Also, the wireless transceiver 197 is provided outside of the imaging drum 120*d* to correspond to the transceiver 199. The wireless transceivers 197 and 199 may be provided according to a conventional two-way wireless communication method like Bluetooth, infrared data association (IrDA) or a wireless universal serial bus (USB).

The wireless transceiver 199 in the imaging drum 120*d* transmits received data to the main controller 180. Then, if the data is image data, the main controller 180 stores the image data to the memory 126. If the data is not image data, the main controller 180 processes the data properly. That is, the main controller converts data into the image data having a proper format to form an image in the image drum of 120*d*. It is possible that the main controller 180 transmits a control command or the like to the wireless transceiver 197 outside the imaging drum 120*d* through the wireless transceiver 199. The control command that the wireless transceiver 197 receives is decoded in the wireless communication controller 196 and transmitted to an element to be controlled thereby.

Thus, the main controller 180 is installed within the imaging drum 120, thereby improving spatial efficiency.

As described above, the present general inventive concept provides an image forming apparatus where image data is transmitted with high reliability to prevent distortion of the image data.

Also, a signal input part and a signal output part are not in contact or an image data is transmitted wirelessly while an imaging drum rotates, thereby preventing wear-out due to friction or deformation due to friction heat of the imaging drum. Thus, durability of an image forming apparatus is improved.

Additionally, image data is transmitted by a wireless communication method, thereby improving spatial efficiency as compared with by the wireline method. Further, a main controller is installed within an imaging drum, and thus the product may be formed small to improve spatial efficiency.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus comprising:

an imaging drum having a hollow cylinder, a plurality of electrodes disposed in the hollow cylinder to form an electric magnetism corresponding to an image on a surface of the hollow cylinder, and a memory disposed in the hollow cylinder to store image data corresponding to the image and to transmit the stored image data to corresponding ones of the plurality of electrodes; and a controller to control the hollow cylinder to stop moving when transmitting the image data to the memory.

2. The image forming apparatus according to claim 1, further comprising:

a toner storage part which stores a conductive and magnetic toner;

a developing part which is accommodated in the toner storage part and generates magnetism to develop the imaging drum with the toner; and a drum driver which rotatably drives the imaging drum and a data receiver which receives image data, wherein the main controller controls the drum driver to keep the imaging drum stopping and stores the image data received by the data receiver in the memory if printing is requested.

3. The image forming apparatus according to claim 2, further comprising:

an electrode driver which is installed inside the imaging drum and applies a voltage to the respective electrodes, wherein the main controller controls the drum driver and the electrode driver so that the imaging drum is rotated and the voltage is applied to the electrode corresponding to the image data stored in the memory if the image data is completely stored in the memory.

4. The image forming apparatus according to claim 2, further comprising:

a signal input part which comprises at least one of a power input contact point and an image data input contact point and is formed to rotate with the imaging drum in a single body;

a signal output part which comprises at least one of a power output contact point in contact with the power input contact point and an image data output contact point in contact with the image data input contact point; and a power supplier which supplies power to the power output contact point, wherein the main controller provides the image data to the image data output contact point.

5. The image forming apparatus according to claim 4, wherein at least one of the signal output part and the signal input part is provided to be relatively movable to the other one of the signal output part and the signal input part so as to be electrically connected and disconnected with each other.

6. The image forming apparatus according to claim 5, further comprising:

a connecting part which moves the signal output part between an in-contact position where the signal output part is connected to the signal input part and an out-of-contact position where the signal output part is disconnected from the signal input part, wherein the main controller controls the connecting part to move the signal output part to the in-contact position if the image data is being received and to the out-of-contact position if the image data has been completely received.

7. The image forming apparatus according to claim 6, wherein the connecting part comprises an electromagnet.

8. The image forming apparatus according to claim 4, wherein the imaging drum comprises a drum shaft parallel to the developing part, and the signal output part is provided to be slidable between an in-contact position where the signal output part is connected to the signal input part and an out-of-contact position where the signal output part is disconnected from the signal input part along the drum shaft.

9. The image forming apparatus according to claim 8, wherein the drum driver comprises:

a driving source which comprises a driving pinion to rotate on a driving shaft parallel with the drum shaft;

a driven part which is rotated by the driving pinion and provided to be slidable between the power transmitting position and the power transmitting release position distanced apart from the power transmitting position along the drum shaft; and a connecting part which is provided to rotate with a drum shaft in a single body and moves the driven part to the power transmitting position and the signal output part to the out-of-contact position, and the driven part to the power transmitting release position and the signal output part to the in-contact position respectively according to turning on/off a power.

10. The image forming apparatus according to claim 9, wherein the main controller turns off power of the connecting part if printing is requested and turns on the power of the connecting part if the image data is completely stored in the memory.

11. The image forming apparatus according to claim 1, wherein the drum driver comprises a driving source and an electronic clutch, and the main controller turns on/off power of the electronic clutch to supply and block a driving force from the driving source to the imaging drum, respectively.

12. The image forming apparatus according to claim 11, wherein:

the driving source comprises a driving pinion; and the electronic clutch is provided to be slidable between a power transmitting position and a power transmitting release position distanced apart from the power transmitting position along a shaft of the imaging drum, and comprises a driven part rotated by the driving pinion and a connecting part provided to rotate with the shaft of the imaging drum in a single body to move the driven part to the power transmitting position and the power transmitting release position according to the on/off of the power, respectively.

13. The image forming apparatus according to claim 2, further comprising:

a wireless transmitter which transmits the image data wirelessly; and a wireless receiver which is provided inside the imaging drum and transmits the transmitted image data to the memory, wherein the main controller controls the wireless transmitter and the wireless receiver so as to transmit/receive the image data wirelessly.

14. The image forming apparatus according to claim 13, wherein the memory comprises a storage part and a memory driver which stores the image data received by the wireless receiver in the storage part.

15. The image forming apparatus according to claim 13, wherein:

the main controller is provided inside the imaging drum; and the image forming apparatus further comprises a wireless communication controller which controls the wireless transmitter to transmit the image data received by the data receiver to the wireless receiver if printing is requested.

16. An imaging drum usable with an image forming apparatus, comprising:

a hollow cylinder;

a plurality of electrodes disposed in the hollow cylinder to form an electric field corresponding to image data, the electric field being formed on a surface of the hollow cylinder; and a memory disposed in the hollow cylinder to store the image data to drive the plurality of electrodes, wherein the hollow cylinder stops moving while the memory receives the image data from an external device according to an external control signal.

17. The imaging drum of claim 16, further comprising:

a wireless communication unit disposed in the hollow cylinder to communicate with the external device to wirelessly receive the image data from the external device.

18. The imaging drum of claim 16, further comprising:

a controller disposed in the hollow cylinder to wirelessly receive a control signal from the external device to control the memory and the plurality of electrodes.

19. The imaging drum of claim 16, further comprising:

a unit to transmit the image data from an external device to the memory;

a connecting part to control the unit to transfer the image data from the external device to the memory.

20. The imaging drum of claim 16, further comprising:

a drum shaft disposed on an end portion of the hollow cylinder;

a first unit disposed on the drum shaft to transmit the image data from the external device to the memory;

a second unit disposed on the drum shaft to transfer a rotation power to the drum shaft; and a connecting part disposed on the drum shaft to control the first unit and second unit to transfer the image data and the rotation power to the memory and the drum shaft, respectively.

21. The imaging drum of claim 20, wherein the first unit and the second unit are movably disposed on the drum shaft on opposite sides with respect to the connecting part.

* * * * *